US011234067B1

(12) United States Patent
Liang et al.

(10) Patent No.: US 11,234,067 B1
(45) Date of Patent: Jan. 25, 2022

(54) HEADPHONE STRUCTURE

(71) Applicant: Eastech (Huizhou) Co., Ltd., Guangdong (CN)

(72) Inventors: Chao-Hui Liang, Guangdong (CN); Man-Ji Gu, Guangdong (CN)

(73) Assignee: EASTECH (HUIZHOU) CO., LTD., Guangdong (CN)

( * ) Notice: Subject to any disclaimer, the term of this patent is extended or adjusted under 35 U.S.C. 154(b) by 0 days.

(21) Appl. No.: 16/986,291

(22) Filed: Aug. 6, 2020

(30) Foreign Application Priority Data

Jul. 3, 2020 (CN) ..... 202021271717.7

(51) Int. Cl.
*H04R 1/10* (2006.01)
*H04R 1/28* (2006.01)

(52) U.S. Cl.
CPC ..... *H04R 1/1016* (2013.01); *H04R 1/1058* (2013.01); *H04R 1/2826* (2013.01); *H04R 2201/02* (2013.01)

(58) Field of Classification Search
CPC ..... H04R 2460/09; H04R 2460/11
See application file for complete search history.

(56) References Cited

U.S. PATENT DOCUMENTS

| | | | | |
|---|---|---|---|---|
| 6,738,487 | B1 * | 5/2004 | Nageno | H04R 1/1016 381/322 |
| 8,885,866 | B2 * | 11/2014 | Sakaguchi | H04R 25/652 381/382 |
| 9,237,394 | B2 * | 1/2016 | Seo | H04R 1/1016 |
| 9,438,989 | B2 * | 9/2016 | Chu | H04R 1/2811 |
| 11,095,968 | B2 * | 8/2021 | Birch | H04R 1/1016 |
| 2012/0201406 | A1 * | 8/2012 | Yamaguchi | H04R 1/1016 381/309 |
| 2019/0208301 | A1 * | 7/2019 | Monti | H04R 25/652 |

* cited by examiner

*Primary Examiner* — Ryan Robinson
(74) *Attorney, Agent, or Firm* — CKC & Partners Co., LLC

(57) ABSTRACT

A headphone structure includes a front housing, a rear housing combined to the front housing, a mesh cover, a sound-producing unit disposed within the front housing, and an elastic earbud. The front housing includes a protruding post portion, a sound channel formed on a front end surface of the protruding post portion, a slit formed on the protruding post portion, and a bearing flange formed on an inner surface of the sound channel to load the mesh cover. One distal end of the slit is connected to the inner surface of the sound channel, and one part of the protruding post portion is arranged between the front end surface of the protruding post portion and the distal end of the slit. The elastic earbud is elastically sleeved on the protruding post portion, so an elongated air vent is formed by the elastic earbud and the slit.

16 Claims, 6 Drawing Sheets

10

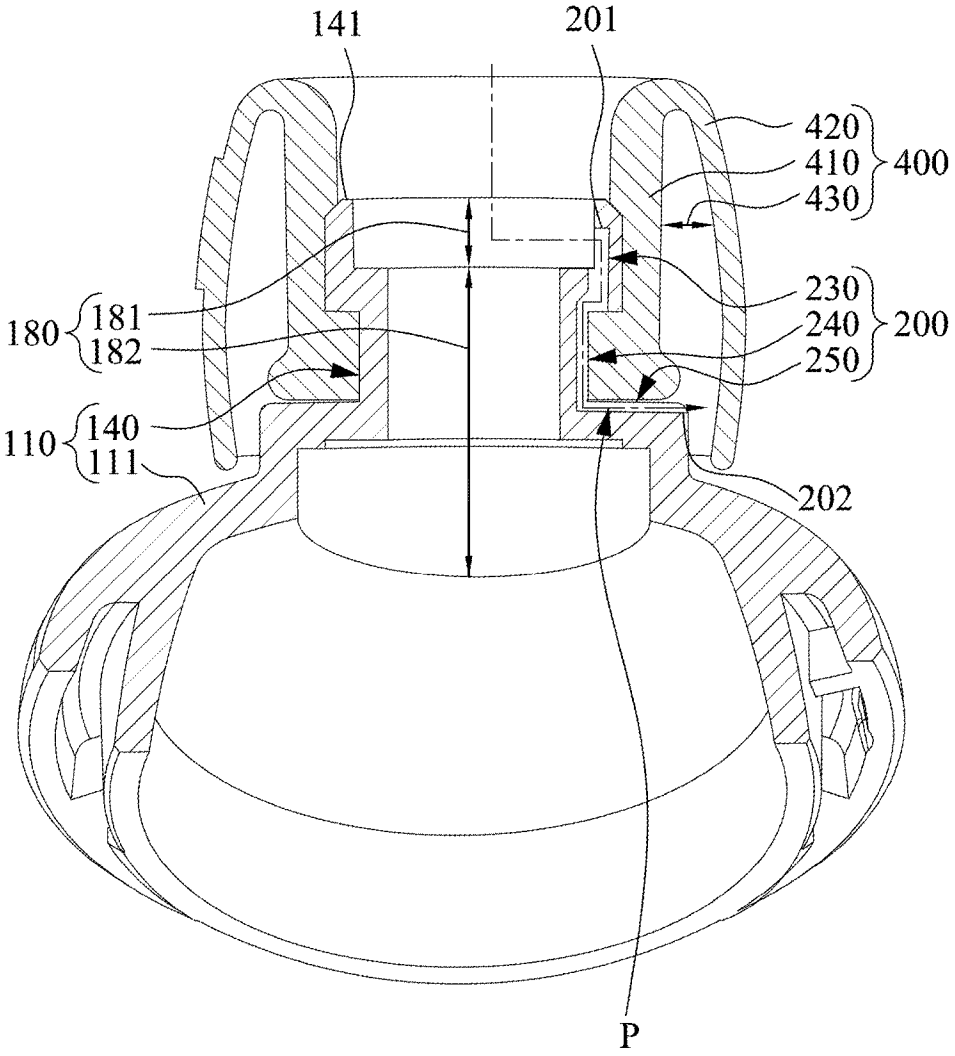
Fig. 4
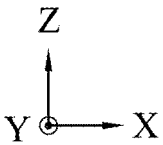

HEADPHONE STRUCTURE

CROSS-REFERENCE TO RELATED APPLICATION

This application claims priority to China Application Serial Number 202021271717.7, filed on Jul. 3, 2020, which is herein incorporated by reference.

BACKGROUND

Technical Field

The present disclosure relates to a headphone structure. More particularly, the present disclosure relates to a headphone structure for improving uncomfortable negative pressure within the ear.

Description of Related Art

In order to listen to music provided from digital devices (such as mobile phones etc.), people normally wear headphones for reducing ambient noise to improve sound quality. The characteristic of the headphone is that a pair of small loudspeakers are placed close to a user's ears so that the user is able to sense space, realism and presence of the special sound field by the earphone.

However, due to wearing headphones for a long time, the user's ears will get uncomfortable because of the difference in air pressure, which will cause hearing impairment.

SUMMARY

One aspect of the present disclosure is to provide a headphone structure to solve the aforementioned problems of the prior art.

In one embodiment of the disclosure, the headphone structure includes a front housing, a rear housing, a mesh cover, a sound-producing unit and an elastic earbud. The front housing includes a protruding post portion, a sound channel, a slit and a bearing flange. The sound channel is concavely formed on a front end surface of the protruding post portion, and extends in a long axis direction of the protruding post portion. The slit is formed on an outer surface of the protruding post portion. The bearing flange is formed on an inner surface of the sound channel. One of two distal ends of the slit is connected to the inner surface of the sound channel, and one part of the protruding post portion is arranged between the front end surface of the protruding post portion and the one of the distal ends of the slit. The mesh cover is fixedly disposed on the bearing flange. The rear housing is combined to the front housing so that an inner space is formed between the rear housing and the front housing. The sound-producing unit is disposed within the inner space therein to sound outwardly through the sound channel. The elastic earbud is elastically sleeved on the protruding post portion, so that an elongated air vent being in communication with the sound channel is collectively formed by an inner wall of the elastic earbud and the slit.

According to one or more embodiments of the disclosure, in the foregoing headphone structure, the other of the distal ends of the slit is located in the elastic earbud.

According to one or more embodiments of the disclosure, in the foregoing headphone structure, the distal ends of the slit are commonly formed on a same side of the protruding post portion.

According to one or more embodiments of the disclosure, in the foregoing headphone structure, the distal ends of the slit are respectively formed on different sides of the protruding post portion.

According to one or more embodiments of the disclosure, in the foregoing headphone structure, the sound channel is divided into an outer area and an inner area by the mesh cover. The one of the distal ends of the slit is in communication with the outer area of the sound channel via the inner surface of the sound channel.

According to one or more embodiments of the disclosure, in the foregoing headphone structure, the slit includes a line groove concavely formed on the outer surface of the protruding post portion, and a through hole connected to the line groove and the outer area of the sound channel, respectively.

According to one or more embodiments of the disclosure, in the foregoing headphone structure, the protruding post portion is provided with a convex base, a cylinder body and a projecting ring body, the convex base is directly connected to the front housing, the cylinder body is connected to, and located between the convex base and the projecting ring body, is narrower than the convex base or the projecting ring body, and the sound channel penetrates through the convex base, the cylinder body and the projecting ring body together, and the slit is formed on the convex base, the cylinder body and the projecting ring body.

According to one or more embodiments of the disclosure, in the foregoing headphone structure, the slit includes a first part, a second part and a third part. The second part is adjoined to the first part and the third part, and is concavely formed on the convex base, the cylinder body and the projecting ring body together along the long axis direction of the protruding post portion. The first part of the slit penetrates through the projecting ring body in a traverse axis direction being orthogonal to the long axis direction, and the third part is formed on a top surface of the convex base facing away from the rear housing, and is partially coved by the elastic earbud.

According to one or more embodiments of the disclosure, in the foregoing headphone structure, the protruding post portion is provided with a hook at the outer surface thereof, and the hook directly abuts against the inner wall of the elastic earbud.

According to one or more embodiments of the disclosure, in the foregoing headphone structure, the front end surface of the protruding post portion is in an enclosed circle.

According to one or more embodiments of the disclosure, in the foregoing headphone structure, a main sound axis of the sound-producing unit is coaxial with a major axis of the sound channel.

In one embodiment of the disclosure, the headphone structure includes a case, a mesh cover, a sound-producing unit, an elastic earbud and an elongated air vent. The case is provided with a sound channel being concavely formed on a front end surface of the case, and the front end surface of the case completely surrounding the sound channel. The mesh cover is fixedly disposed within the sound channel to divide the sound channel into an outer area and an inner area. The sound-producing unit is disposed inside the case to sound outwards from the mesh cover. The elastic earbud is elastically sleeved on the case to surround the sound channel. The elongated air vent is formed between the case and the elastic earbud, and one of two distal ends of the elongated air vent is in direct communication with the outer area of the sound channel through the case.

According to one or more embodiments of the disclosure, in the foregoing headphone structure, the other of the distal ends of the elongated air vent is located inside the elastic earbud.

According to one or more embodiments of the disclosure, in the foregoing headphone structure, the case includes a protruding post portion. The protruding post portion is provided with a convex base, a cylinder body and a projecting ring body. The cylinder body is connected to, and located between the convex base and the projecting ring body, is narrower than the convex base or the projecting ring body, and the sound channel penetrates through the convex base, the cylinder body and the projecting ring body together, and the elongated air vent is formed on the convex base, the cylinder body and the projecting ring body.

According to one or more embodiments of the disclosure, in the foregoing headphone structure, the case is provided with a hook at the outer surface thereof, and the hook directly abuts against the inner wall of the elastic earbud.

According to one or more embodiments of the disclosure, in the foregoing headphone structure, the front end surface of the case is in an enclosed circle.

According to one or more embodiments of the disclosure, in the foregoing headphone structure, a main sound axis of the sound-producing unit is coaxial with a major axis of the sound channel.

Thus, through the structure of the above embodiments, the present disclosure is able to release and balance the negative pressure in the user's ear through the elongated air vent, reduce the possibility of ear discomfort and damage, and adjust the adaptive output frequency.

The above description is merely used for illustrating the problems to be resolved, the technical methods for resolving the problems and their efficacies, etc. The specific details of the present disclosure will be explained in the embodiments below and related drawings.

BRIEF DESCRIPTION OF THE DRAWINGS

The accompanying drawings are included to provide a further understanding of the present disclosure, and are incorporated in and constitute a part of this specification. The drawings illustrate embodiments of the disclosure and, together with the description, serve to explain the principles of the disclosure. In the drawings.

FIG. 4 is a partial cross-sectional view of the front housing of the headphone structure viewed from another aspect in FIG. 1.

DETAILED DESCRIPTION

Figure 1:
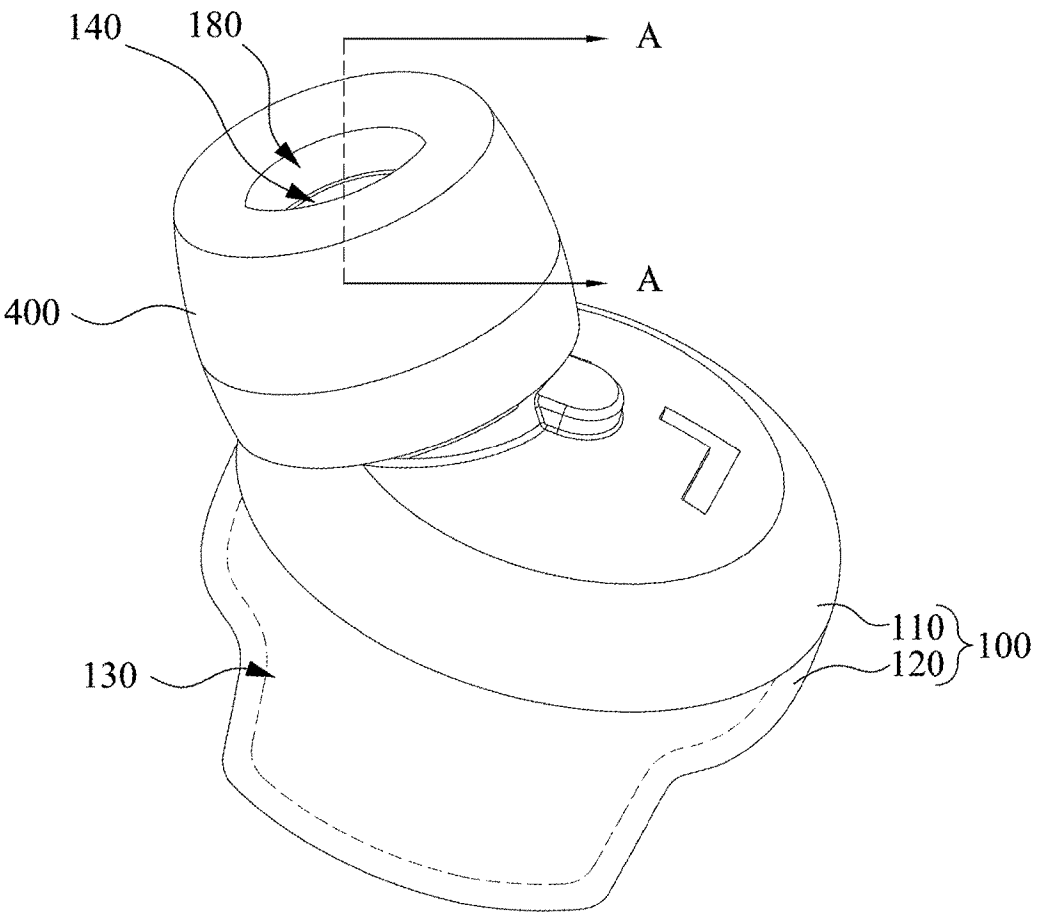
FIG. 1 is a three dimensional view of a headphone structure according to one embodiment of the present disclosure.

Reference will now be made in detail to the present embodiments of the present disclosure, examples of which are illustrated in the accompanying drawings. Wherever possible, the same reference numbers are used in the drawings and the description to refer to the same or like parts. According to the embodiments, it will be apparent to those skilled in the art that various modifications and variations can be made to the structure of the disclosure without departing from the scope or spirit of the disclosure.

Figure 2:
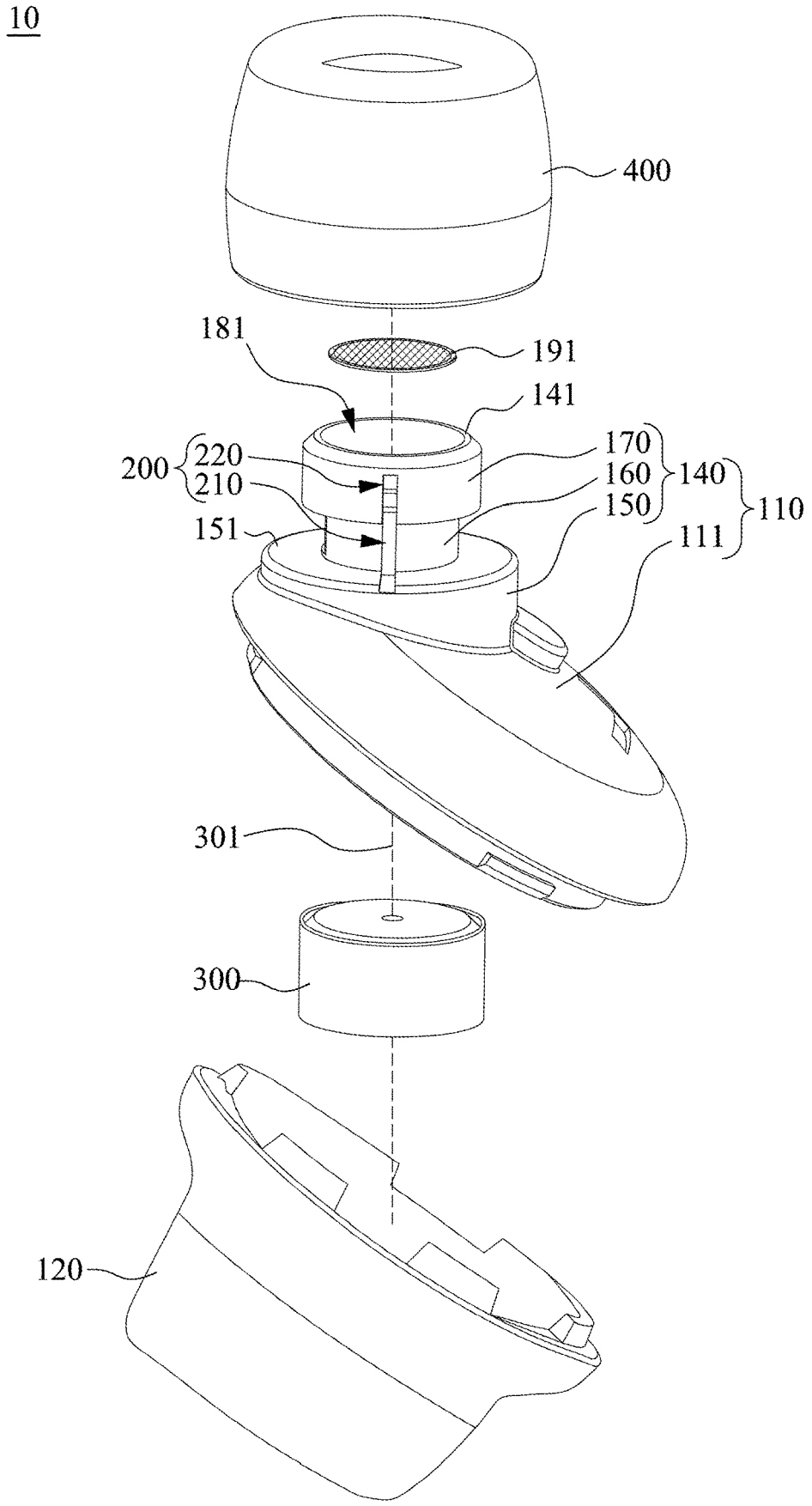
FIG. 2 is an exploded view of the headphone structure in FIG. 1.
Figure 3A:
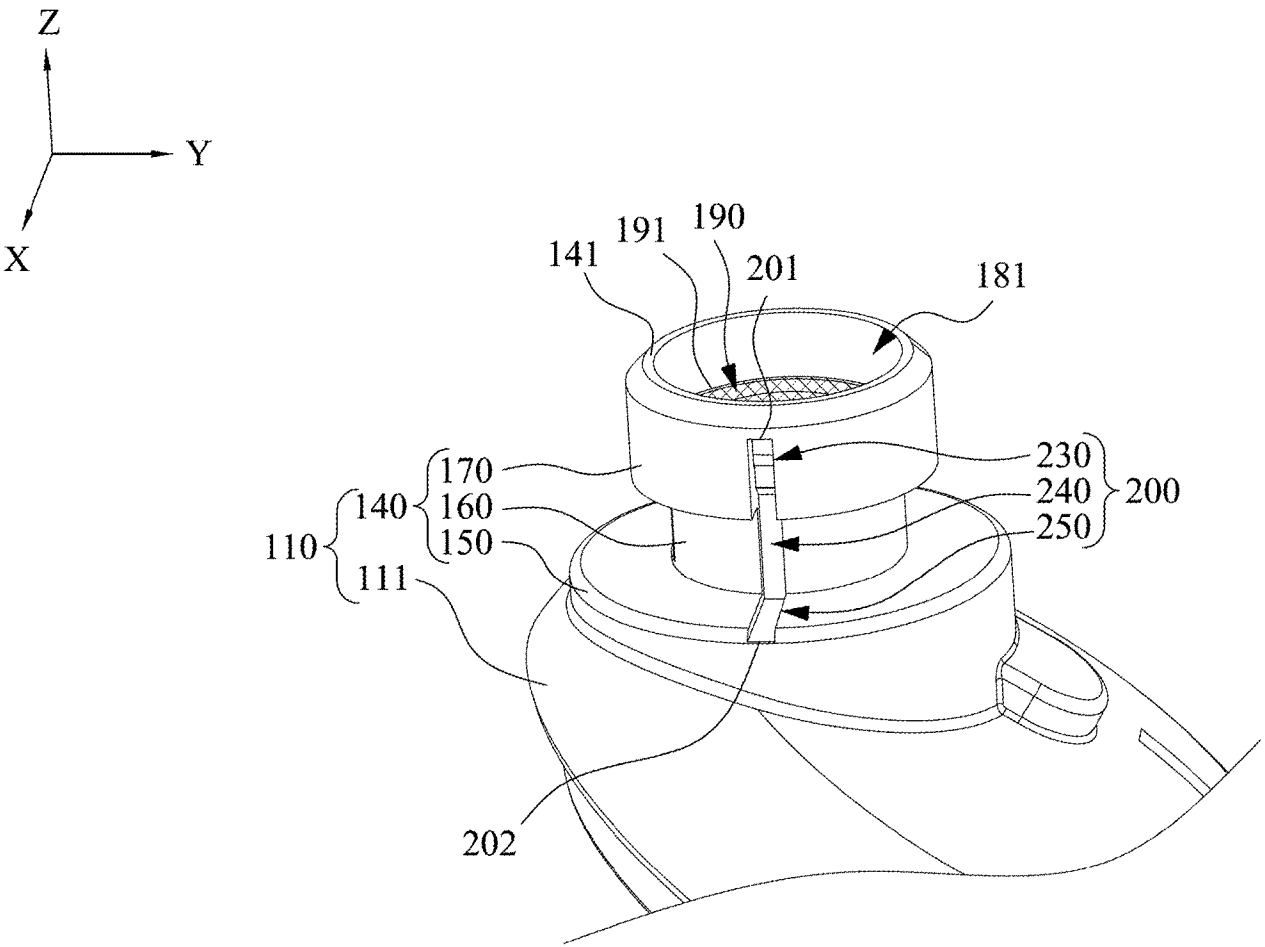
FIG. 3A is a partial three dimensional view of the front housing of the headphone structure viewed from one aspect in FIG. 1.
Figure 3B:
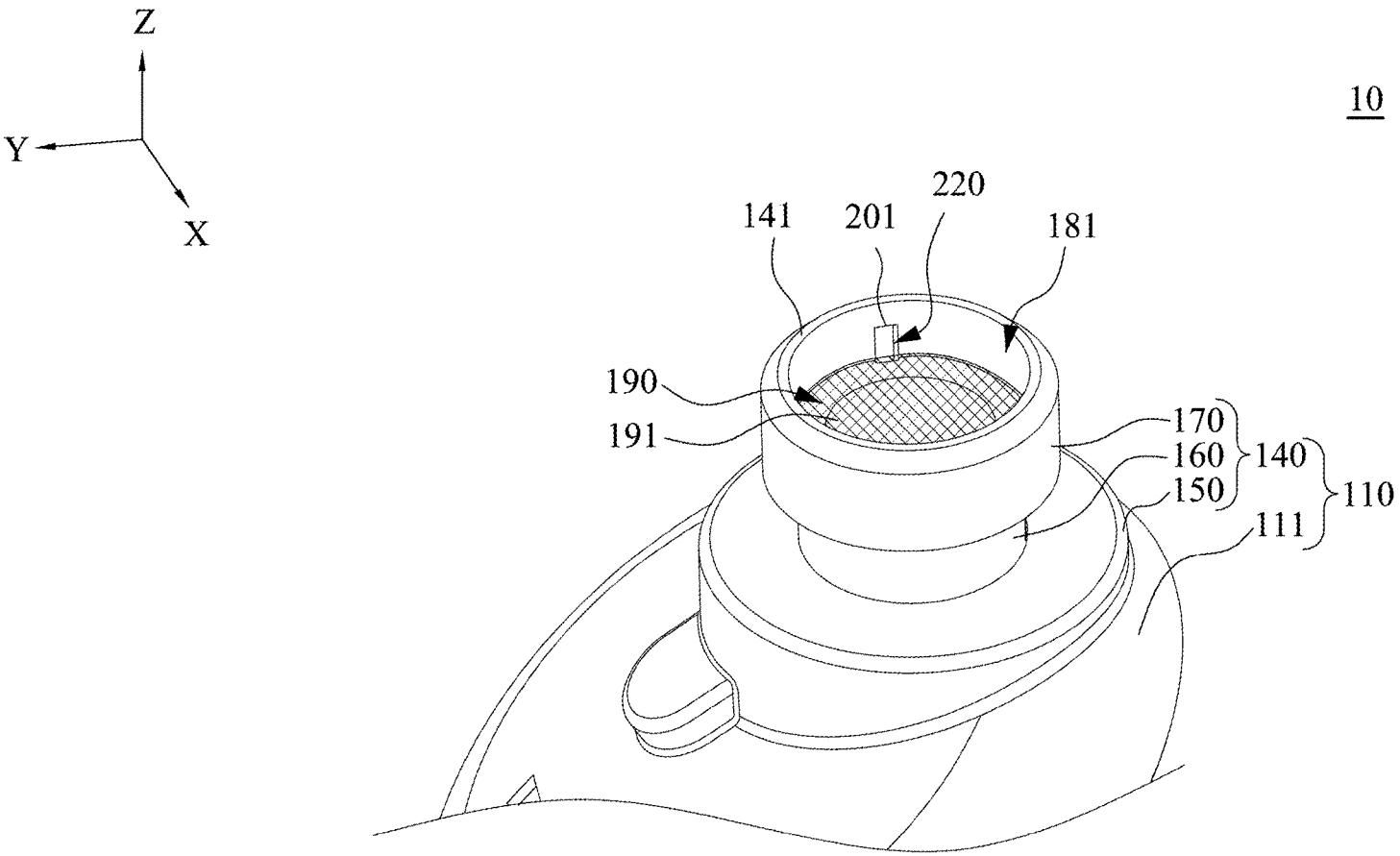
FIG. 3B is a partial three dimensional view of the front housing of the headphone structure viewed from another aspect in FIG. 1.

Reference is now made to FIG. 1 to FIG. 4 in which FIG. 1 is a three dimensional view of a headphone structure 10 according to one embodiment of the present disclosure, FIG. 2 is an exploded view of the headphone structure 10 in FIG. 1, FIG. 3A is a partial three dimensional view of the front housing 110 of the headphone structure 10 viewed from one aspect in FIG. 1, FIG. 3B is a partial three dimensional view of the front housing 110 of the headphone structure 10 viewed from another aspect in FIG. 1, and FIG. 4 is a partial cross-sectional view of the front housing 110 of the headphone structure 10 viewed from another aspect in FIG. 1. As shown in FIG. 1 to FIG. 4, in one embodiment, the headphone structure 10 includes a case 100, a sound-producing unit 300 and an elastic earbud 400. The case 100 includes a front housing 110 and a rear housing 120 which are assembled to each other, so that an inners space 130 is defined between the front housing 110 and the rear housing 120. The front housing 110 includes a main body 111, a protruding post portion 140, a sound channel 180, a slit 200 and a bearing flange 190. The protruding post portion 140 is protrudingly formed on the main body 111 of the front housing 110, and one distal end of the protruding post portion 140 facing away from the main body 111 is formed with a front end surface 141. The front end surface 141 of the case 100 completely surrounds the sound channel 180. For example, the front end surface 141 of the protruding post portion 140 is in an enclosed shape, for example, enclosed circle, so as to facilitate to reduce water intrusion into the slit 200. However, the disclosure is not limited thereto.

The sound channel 180 is formed within the protruding post portion 140 to penetrate through the front end surface 141 of the protruding post portion 140. The sound channel 180 extends in a long axis direction (e.g., axial direction Z) of the protruding post portion 140. In other words, the long axis direction (e.g., axial direction Z) of the protruding post portion 140 is coaxial with a major axis (e.g., axial direction Z) of the sound channel 180. However, the disclosure is not limited thereto. The bearing flange 190 is disposed within the protruding post portion 140, located on the inner wall surface of the sound channel 180, for example, the bearing flange 190 is in a circular ring shape.

The headphone structure 10 further includes a mesh cover 191. The mesh cover 191 is fixedly covered on the bearing flange 190, for example, adhered on the bearing flange 190 through a cushion glue layer (not shown in the figures). The slit 200 is formed the outer surface of the protruding post portion 140 to be in communication with the sound channel 180 through the protruding post portion 140. The sound-producing unit 300 is disposed within the inners space 130 of the case 100 to sound outwards from the mesh cover 191. In the embodiment, a main sound axis 301 of the sound-producing unit 300 is coaxial with a major axis (e.g., axial direction Z) of the sound channel 180 for meeting the specific vocalization requirements, however, the disclosure is not limited to this. The elastic earbud 400 is elastically sleeved on the protruding post portion 140, so that an elongated air vent P being in communication with the sound channel 180 is collectively formed by an inner wall of the elastic earbud 400 and the slit 200. Thus, since the slit 200 is formed on the protruding post portion 140, not only the negative pressure in the ear of the user can be balanced, but also lower frequency sound effect can be adjusted.

More specifically, the mesh cover 191 is in a planar shape, and is abutted against the inner surface of the sound channel 180 in the axial direction X. The mesh cover 191 (or bearing flange 190) is disposed in the sound channel 180 to divide the sound channel 180 into an outer area 181 and an inner area 182. The slit 200 includes a first distal end 201 and a second distal end 202 which are opposite to each other. The first distal end 201 of the slit 200 is in communication with the inner surface of the sound channel 180, and the first distal end 201 of the slit 200 is in communication with the outer area 181 of the sound channel 180 via the inner surface of the sound channel 180. The second distal end 202 of the slit 200 is disposed within the elastic earbud 400, and one part of the protruding post portion 140 is arranged between the front end surface 141 of the protruding post portion 140 and the first distal end 201 of the slit 200.

On another hand, the slit 200 can be a combination of a line groove 210 and a through hole 220. The line groove 210 is concavely formed on the outer surface of the protruding post portion 140 in a long axis direction (e.g., axial direction Z) of the protruding post portion 140. The through hole 220 is connected to the line groove 210 and the outer area 181 of the sound channel 180, respectively. The through hole 220 is, for example, in a rectangular shape, however, the disclosure is not limited thereto, and the through hole 220 may also be round or square.

Furthermore, in the embodiment, the protruding post portion 140 is provided with a convex base 150, a cylinder body 160 and a projecting ring body 170. The convex base 150 is directly connected to the front housing 110, the cylinder body 160 is connected to, and located between the convex base 150 and the projecting ring body 170, and the cylinder body 160 is narrower than the convex base 150 or the projecting ring body 170. The sound channel 180 penetrates through the convex base 150, the cylinder body 160 and the projecting ring body 170 together. The slit 200 is formed on the convex base 150, the cylinder body 160 and the projecting ring body 170. For example, the convex base 150, the cylinder body 160 and the projecting ring body 170 are integrally connected one another.

Furthermore, the slit 200 includes a first part 230, a second part 240 and a third part 250. The second part 240 is arranged between the first part 230 and the third part 250, and is adjoined to the first part 230 and the third part 250. The first part 230 of the slit 200 penetrates through the projecting ring body 170 in a traverse axis direction (e.g., axial direction X) being orthogonal to the long axis direction of the protruding post portion 140. The second part 240 is concavely formed on the convex base 150, the cylinder body 160 and the projecting ring body 170 together along the long axis direction (e.g., axial direction Z) of the protruding post portion 140. The third part 250 is formed on a top surface 151 of the convex base 150 facing away from the rear housing along the traverse axis direction (e.g., axial direction X) of the protruding post portion 140, and is partially coved by the elastic earbud 400 so that the second distal end 202 of the slit 200 will not be covered by the elastic earbud 400 so as to be hidden within the elastic earbud 400.

The elastic earbud 400 includes an elastic sleeve body 410 and an earplug bud 420. The elastic sleeve body 410 is sleeved on the outer wall surface of the cylinder body 160, is engaged between the convex base 150 and the projecting ring body 170, and is pressed on the projecting ring body 170. The earplug bud 420 is integrally connected to one end of the elastic sleeve body 410 to surround the elastic sleeve body 410 with a gap 430 therebetween. The elastic sleeve body 410 elastically covers the second part 240 and the third part 250 of the slit 200, and the second distal end 202 of the slit 200 is exposed within the gap 430. However, the disclosure is not limited to this. In other embodiments, as long as the second distal end 202 of the slit 200 is not elastically covered by the elastic earbud 400 to achieve air convection outwardly, the shape and position of the slit 200 are not limited.

In the embodiment, the entire width of the slit 200 is equivalent, and the entire depth of the slit 200 is equivalent. Thus, by adjusting the size of the slit 200, the adjustment range of the bass frequency can be determined, so as to control the sound of the bass frequency range. However, the disclosure is not limited to this. In other embodiments, the overall width of the slit 200 may be non-uniform, or the overall depth of the slit 200 is non-uniform.

Also, in another embodiment of the disclosure, the protruding post portion 140 is provided with a hook (not shown in figures) at the outer surface of the protruding post portion 140. The hook is integrally formed on the outer surface of the protruding post portion 140, and the hook directly abuts against the elastic earbud 400 to contact the inner wall surface of the protruding post portion 140. In this way, the elastic earbud 400 is stably confined on the protruding post portion 140 by the hook.

Figure 5:
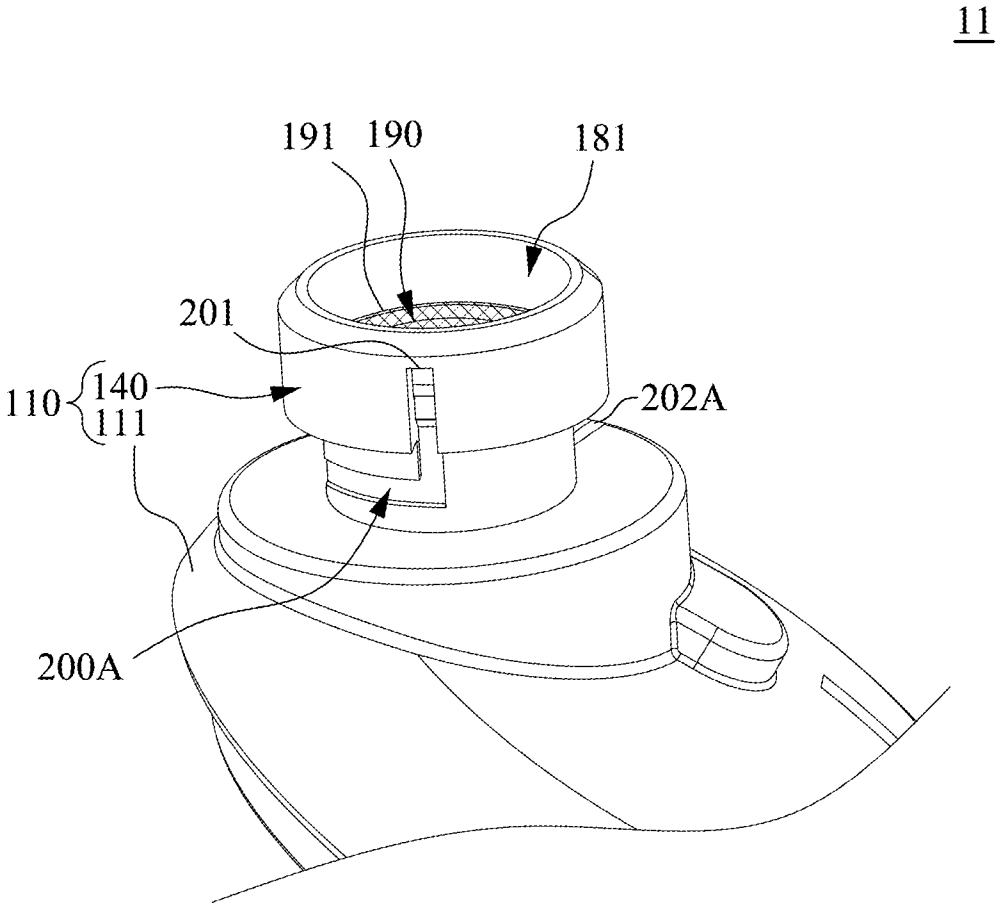
FIG. 5 is a three dimensional view of a front housing of a headphone structure according to another embodiment of the present disclosure.

In this embodiment, the first distal end 201 and the second distal end 202 of the slit 200 are both formed on the same side of the protruding post portion 140, however, the disclosure is not limited to this. In other embodiments, the first distal end 201 and the second distal end 202A of the slit 200 are both formed on different sides of the protruding post portion 140. FIG. 5 is a three dimensional view of a front housing 110A of a headphone structure 11 according to another embodiment of the present disclosure. As shown in FIG. 5, for example, the slit 200A is wound on the cylinder body 160 of the protruding post portion 140 from one side to the opposite side thereof to provide a more flexible design.

It is noted, in the embodiments above, when the headphone structure 10 is classified as for left ear or right ear, the slit of the earphone structure for the left ear is on the left side of the protruding post portion 140, and the slit of the earphone structure for the right ear is on the right side of the protruding post portion 140. In other words, the respective slits of the earphone structures are symmetrical to each other. For example, in this embodiment, the headphone structure 10 is an in-ear earphone. However, the disclosure is not limited to the earphone structure to be an in-ear or earplug earphone.

Thus, through the structure of the above embodiments, the present disclosure is able to release and balance the negative pressure in the user's ear through the elongated air vent, reduce the possibility of ear discomfort and damage, and adjust the adaptive output frequency.

It will be apparent to those skilled in the art that various modifications and variations can be made to the structure of the present disclosure without departing from the scope or spirit of the disclosure. In view of the foregoing, it is intended that the present disclosure cover modifications and variations of this disclosure provided they fall within the scope of the following claims.

What is claimed is:

1. A headphone structure, comprising:

a front housing comprising a protruding post portion;

a sound channel concavely formed on a front end surface of the protruding post portion and extending in a long axis direction of the protruding post portion;

a slit formed on an outer surface of the protruding post portion; and a bearing flange formed on an inner surface of the sound channel, wherein one of two distal ends of the slit is connected to the inner surface of the sound channel, and one part of the protruding post portion is arranged between the front end surface of the protruding post portion and the one of the two distal ends of the slit;

a mesh cover fixedly disposed on the bearing flange;

a rear housing combined to the front housing so that an inner space is formed between the rear housing and the front housing;

a sound-producing unit disposed within the inner space therein to sound outwardly through the sound channel; and an elastic earbud elastically sleeved on the protruding post portion, so that an elongated air vent being in communication with the sound channel is collectively formed by an inner wall of the elastic earbud and the slit.

2. The headphone structure of claim 1, wherein the other of the two distal ends of the slit is located in the elastic earbud.

3. The headphone structure of claim 2, wherein the two distal ends of the slit are commonly formed on a same side of the protruding post portion.

4. The headphone structure of claim 2, wherein the two distal ends of the slit are respectively formed on different sides of the protruding post portion.

5. The headphone structure of claim 1, wherein the sound channel is divided into an outer area and an inner area by the mesh cover, wherein the one of the two distal ends of the slit is in communication with the outer area of the sound channel via the inner surface of the sound channel.

6. The headphone structure of claim 5, wherein the slit comprises a line groove concavely formed on the outer surface of the protruding post portion, and a through hole connected to the line groove and the outer area of the sound channel, respectively.

7. The headphone structure of claim 1, wherein the protruding post portion is provided with a convex base, a cylinder body and a projecting ring body, the convex base is directly connected to the front housing, the cylinder body is connected to the convex base and the projecting ring body, and the cylinder body is narrower than the convex base or the projecting ring body, and the sound channel penetrates through the convex base, the cylinder body and the projecting ring body together, and the slit is formed on the convex base, the cylinder body and the projecting ring body.

8. The headphone structure of claim 7, wherein the slit comprises a first part, a second part and a third part, the second part is adjoined to the first part and the third part, and is concavely formed on the convex base, the cylinder body and the projecting ring body together along the long axis direction of the protruding post portion, wherein the first part of the slit penetrates through the projecting ring body in a traverse axis direction being orthogonal to the long axis direction, and the third part is formed on a top surface of the convex base facing away from the rear housing, and is partially coved by the elastic earbud.

9. The headphone structure of claim 1, wherein the protruding post portion is provided with a hook at the outer surface thereof, and the hook directly abuts against the inner wall of the elastic earbud.

10. The headphone structure of claim 1, wherein the front end surface of the protruding post portion is in an enclosed circle.

11. The headphone structure of claim 1, wherein a main sound axis of the sound-producing unit is coaxial with a major axis of the sound channel.

12. A headphone structure, comprising:

a case having a sound channel being concavely formed on a front end surface of the case, and the front end surface of the case completely surrounding the sound channel, wherein the case further comprises a protruding post portion, and the protruding post portion is provided with a convex base, a cylinder body and a projecting ring body, the cylinder body that is connected to, and located between the convex base and the projecting ring body, is narrower than the convex base or the projecting ring body, and the sound channel penetrates through the convex base, the cylinder body and the projecting ring body together;

a mesh cover fixedly disposed within the sound channel to divide the sound channel into an outer area and an inner area;

a sound-producing unit disposed inside the case to sound outwards from the mesh cover;

an elastic earbud elastically sleeved on the case to surround the sound channel; and an elongated air vent formed between the case and the elastic earbud, and one of two distal ends of the elongated air vent that is in direct communication with the outer area of the sound channel through the case, wherein the elongated air vent is formed on the convex base, the cylinder body and the projecting ring body.

13. The headphone structure of claim 12, wherein the other of the distal ends of the elongated air vent is located inside the elastic earbud.

14. The headphone structure of claim 12, wherein the case is provided with a hook at an outer surface of the case, and the hook directly abuts against an inner wall of the elastic earbud.

15. The headphone structure of claim 12, wherein the front end surface of the case is in an enclosed circle.

16. The headphone structure of claim 12, wherein a main sound axis of the sound-producing unit is coaxial with a major axis of the sound channel.

* * * * *